United States Patent [19]

Steiner

[11] 3,990,484

[45] Nov. 9, 1976

[54] DEVICE FOR SUPPORTING A ROTARY REED ON A SHAFT SHED WEAVING MACHINE

[75] Inventor: Alois Steiner, Rieden, Switzerland

[73] Assignee: Ruti Machinery Works Ltd., Ruti, Zurich, Switzerland

[22] Filed: Mar. 17, 1975

[21] Appl. No.: 559,053

[30] Foreign Application Priority Data

Apr. 8, 1974 Switzerland ..... 4869/74

[52] U.S. Cl. ..... 139/436; 139/188 R; 139/191

[51] Int. Cl.[2] ..... D03D 47/26; D03D 49/60

[58] Field of Search ..... 139/188 R, 190, 191, 139/12, 13, 436

[56] References Cited

UNITED STATES PATENTS 3,895,654 7/1975 Welzel et al. ..... 139/12

*Primary Examiner*—James Kee Chi

*Attorney, Agent, or Firm*—Donald D. Denton

[57] ABSTRACT

A device for supporting a rotary reed on a shaft shed weaving machine in which a rotary reed having a radially projecting profile is supported in portions of its periphery by rotary roll bodies to provide relief of the loading on the summit area of the rotary reed profile.

4 Claims, 2 Drawing Figures

DEVICE FOR SUPPORTING A ROTARY REED ON A SHAFT SHED WEAVING MACHINE

BACKGROUND OF THE INVENTION

The present invention relates to a device for supporting a rotary reed on a shaft shed weaving loom, whereby the said rotary reed has a cylindrical casing with a radially projecting profile extending helically over the entire reed length, whereby the rotary reed is supported in portions of its periphery by rotary roll bodies.

A rotary reed on a shaft shed weaving machine forms an important part of the beating-up system for beating up the inserted filling yarns to the length of fabric. Thus, such a rotary reed extends substantially over the entire width of the machine and comprises a plurality of flattened wires tentered on a drive shaft, which with the peripheral area thereof define the cylindrical casing with the helical profile. The summit area of the profile or the corresponding areal terminations of the individual flattened wires cause the beating up of the filling yarns whereby the warp yarns are located in the gaps between the flattened wires.

The supporting of the rotary reed over its entire length represents a significant problem in this connection. All the hitherto known devices for supporting the rotary reed use supporting surfaces whereon is placed the summit area of the profile of the rotary reed. Proposals have admittedly already been made to form the supporting surfaces by rotary roll bodies in order to reduce the friction relative to stationary supporting surfaces, but then the supporting pressure acts on the summit area of the rotary reed profile with the greatest precision which is very disadvantageous. Another important point is that the axial areal extension of the summit area of the profile is small compared with that of the cylindrical casing portions which leads to a correspondingly high areal loading of the peripheral surface areas of the individual flattened wires.

SUMMARY OF THE INVENTION

The present invention therefore obviates the disadvantages of the known devices of a shaft shed weaving loom by providing a device of the type indicated hereinbefore which in particular completely relieves the loading on the summit area of the rotary reed profile, accompanied by the optimum support thereof over the entire axial zone. According to the device of the invention, this is achieved in that the rotary roll body has at least one profile corresponding to the rotary reed profile which is axially displaced relative to the reed profile and whereof the summit rests on the cylindrical reed casing, whereby the roll body profile has a greater height than the reed profile.

According to an advantageous development of this device, the rotary roll bodies have two identical profiles which are staggered relative to one another which together are axially supported on the cylindrical casing of the rotary reed on both sides of the profile thereof. A modification in the device is that the rotary roll bodies are arranged on the rotary reed so as to be alternately laterally staggered relative to one another in the axial direction and the rotary reed is alternately supported on either side of each convolution of the profile.

BRIEF DESCRIPTION OF THE DRAWINGS

These and other objects and advantages of the present invention will be apparent from the following description and claims and are illustrated in the accompanying drawings which by way of illustration show preferred embodiments of the present invention and the principles thereof, and in which drawings:

DESCRIPTION OF PREFERRED EMBODIMENTS

Figure 1:
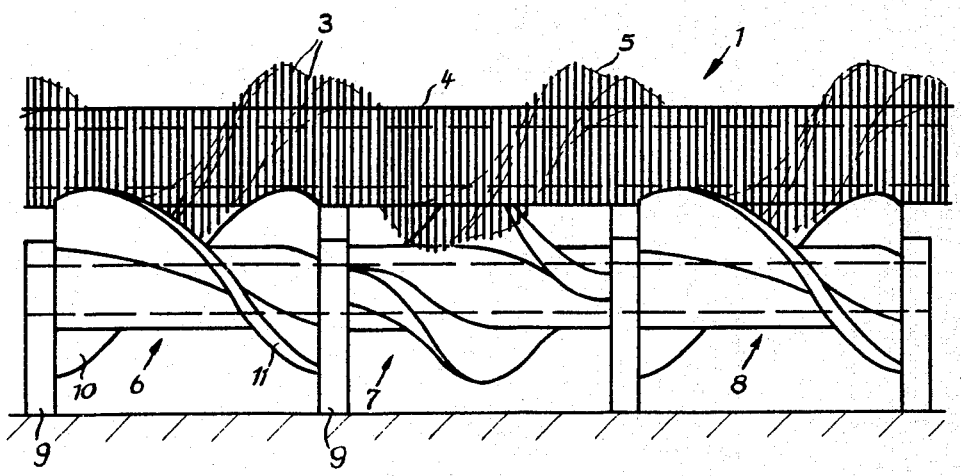
FIG. 1 shows a longitudinal front view cutaway portion of a rotary reed of a shaft shed weaving loom with means for supporting the same.
Figure 2:
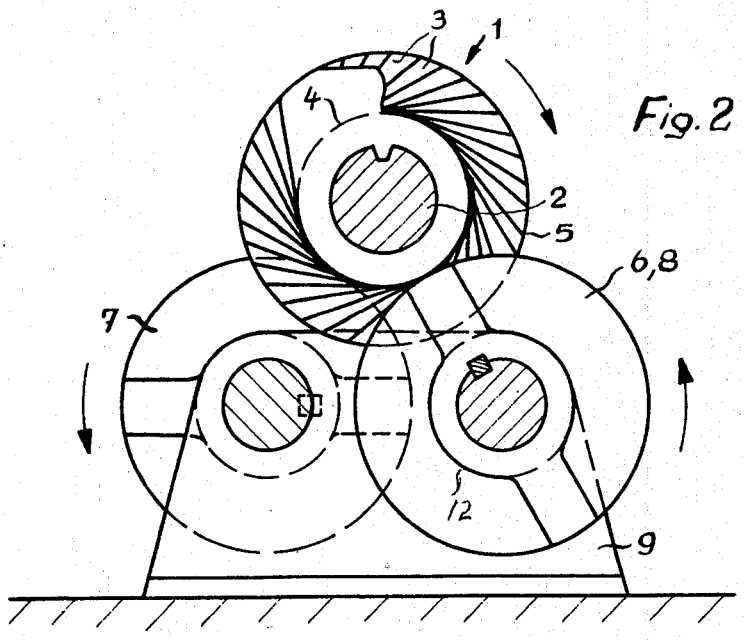
FIG. 2 shows a side view of the arrangement set forth in FIG. 1.

FIGS. 1 and 2 illustrate a rotary reed of a shaft shed weaving loom or machine (not shown), which extends over the width of the weaving machine and is mounted on a driven shaft 2. Positioned on shaft 2 are a large number of flattened wires 3 defining with their peripheral area a cylindrical casing with a radially projecting profile extending helically over the entire length of the reed. Such an arrangement is well known in the art.

A plurality, in the present case three, of rotary roll bodies 6, 7 and 8 are provided to support this rotary reed over its entire axial zone. The spindle of each of these roll bodies is supported in rotary manner by bearing boxes 9 spaced over the width of the weaving machine. Furthermore, each roll body has two reciprocally staggered identical profiles 10, 11 which are axially displaced relative to the profile 5 of rotary reed 1 in such a way that they can rest with their summit on the cylindrical casing 4 of rotary reed 1.

To prevent the summit of profile 5 of rotary reed 1 from coming into contact with the roll body casing 12, the profiles 10 and 11 of roll body 6, 7 or 8 have a greater height than that of profile 5 of rotary reed 1. As a result of this arrangement, the rotary reed 1 is supported on its cylindrical casing 4 in the axial direction on both sides of its profile 5, whereby however the summit of profile 5 or the profile itself are completely load-relieved.

As is shown particularly clearly in FIG. 2, the rotary roll bodies 6, 7, and 8 in the axial direction are arranged alternately reciprocally laterally displaced on rotary reed 1, so that the latter is alternately supported on either side of each convolution of its profile 5. In this way, optimum supporting is obtained over the entire axial zone of the rotary reed, without thereby exerting any pressure on the relatively sensitive areas of the flattened wires 3 forming the summit of profile 5.

While there has been described and illustrated the preferred embodiments of the invention, it is to be understood that these are capable of variation and modification and are not, therefore, limited to the precise details set forth in the specification but include such modifications and alterations as fall within the scope of the appended claims.

What is claimed is:

1. A device for supporting a rotary reed on a shaft on a travelling wave weaving machine, the rotary reed having a cylindrical casing and a radially projecting profile extending helically over the entire length of said reed, characterized in that the rotary reed is supported on spaced portions of its periphery by a plurality of rotary roll bodies, each of said rotary roll bodies having at least one radially projecting profile corresponding to said rotary reed profile, the said roll body profile being axially displaced relative to the reed profile and the summit of said roll body profile operatively supporting the cylindrical shaped casing of the rotary reed and the roll body having a greater radially projecting profile height than the radially projecting profile height of the rotary reed.

2. A device according to claim 1 wherein the rotary roll body has two reciprocally displaced identical profiles which jointly support the cylindrical casing of the rotary reed in the axial direction on either side of its profile.

3. A device according to claim 1 wherein the rotary roll bodies in the axial direction are arranged in alternately laterally displaced manner on the rotary reed, so that the rotary reed is alternately supported on either side in each convolution of the profile.

4. A device according to claim 2 wherein the rotary roll bodies in the axial direction are arranged in alternately laterally displaced manner on the rotary reed, so that the rotary reed is alternately supported on either side in each convolution of the profile.

* * * * *